US009146485B2

(12) United States Patent
Tani et al.

(10) Patent No.: US 9,146,485 B2
(45) Date of Patent: Sep. 29, 2015

(54) MAGENTA TONER AND METHOD FOR PRODUCING THE SAME

(75) Inventors: Yutaka Tani, Yokohama (JP); Masao Nakano, Kamakura (JP); Takayuki Ujifusa, Ashigarakami-gun (JP); Taichi Shintou, Saitama (JP); Kaoru Takahashi, Saitama (JP); Satoshi Saito, Mishima (JP); Takayuki Toyoda, Yokohama (JP); Takeshi Miyazaki, Ebina (JP); Masashi Hirose, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/119,430

(22) PCT Filed: Jul. 24, 2012

(86) PCT No.: PCT/JP2012/069278

§ 371 (c)(1),
(2), (4) Date: Nov. 21, 2013

(87) PCT Pub. No.: WO2013/015439

PCT Pub. Date: Jan. 31, 2013

(65) Prior Publication Data

US 2014/0113229 A1 Apr. 24, 2014

(30) Foreign Application Priority Data

Jul. 27, 2011 (JP) ..... 2011-163863

(51) Int. Cl.
*G03G 9/09* (2006.01)
*G03G 9/08* (2006.01)

(52) U.S. Cl.
CPC ..... *G03G 9/09* (2013.01); *G03G 9/0804* (2013.01); *G03G 9/0806* (2013.01); *G03G 9/092* (2013.01); *G03G 9/0916* (2013.01)

(58) Field of Classification Search
CPC ..... G03G 9/0916; G03G 9/092; G03G 9/09; G03G 9/0804; G03G 9/0806
USPC ..... 430/108.21, 137.17, 137.19
See application file for complete search history.

(56) References Cited

U.S. PATENT DOCUMENTS 5,187,282 A 2/1993 Carlier et al.
5,354,639 A * 10/1994 Kasuya et al. ..... 430/110.2
5,935,751 A * 8/1999 Matsuoka et al. ..... 430/108.8
2009/0291375 A1 11/2009 Fujisaki et al.
2011/0177442 A1* 7/2011 Vanbesien et al. ..... 430/107.1
2014/0162182 A1 6/2014 Nakano et al.

FOREIGN PATENT DOCUMENTS

GB 2477038 A 7/2011
JP 5-117536 A 5/1993
JP 7-20651 A 1/1995
JP 7-36212 A 2/1995
JP 7-43932 A 2/1995
JP 9-255882 A 9/1997
JP 2009-229497 A 10/2009

OTHER PUBLICATIONS

American Chemical Society (ACS) File Registry No. 980-26-7 on STN, copyright 2014, which was entered in STN on Nov. 16, 1984.*
American Chemical Society (ACS) File Registry No. 81-39-0 on STN, copyright 2014, which was entered in STN on Nov. 16, 1984.*
International Search Report and Written Opinion of the International Searching Authority, International Application No. PCT/JP2012/069278, Mailing Date Oct. 9, 2012.
European Search Report dated Feb. 19, 2015 in European Application No. 12817977.7.

* cited by examiner

*Primary Examiner* — Janis L Dote
(74) *Attorney, Agent, or Firm* — Fitzpatrick, Cella, Harper and Scinto

(57) ABSTRACT

An object of the present invention is to provide a magenta toner having high dispersibility of a colorant and good spectral characteristics.
A magenta toner includes a magenta toner particle including at least a binder resin, a compound represented by the formula (1), and a colorant, wherein the colorant includes a pigment having a quinacridone skeleton:

Formula (1)

(wherein $R_1$ and $R_2$ each independently represent a hydrogen atom, an alkyl group, an aryl group, or an aralkyl group.)

11 Claims, 3 Drawing Sheets

MAGENTA TONER AND METHOD FOR PRODUCING THE SAME

TECHNICAL FIELD

The present invention relates to a magenta toner used in recording methods such as electrophotography, electrostatic recording, magnetic recording, a toner jet method, and liquid development, and a method for producing the magenta toner.

BACKGROUND ART

Recently, color images are widely spread, and higher image quality has been increasingly demanded. In digital full color copiers and printers, a color image manuscript is subjected to color separation with filters of blue, green, and red, and latent images corresponding to the original image are developed with developers of yellow, magenta, and cyan, which are complementary colors of blue, green, and red, and a black developer. For this reason, the colorants in the developers of the respective colors give a great influence to image quality, particularly, color tone, transparency, and color reproducibility. In the color toners, the magenta toner is important in reproduction of a skin color. Further, the color tone of the skin in a human figure is a halftone. Accordingly, high developing properties are also demanded. For such demands, as a colorant for a magenta toner, quinacridone colorants, thioindigo colorants, xanthene colorants, monoazo colorants, perylene colorants, and diketopyrrole colorants are known.

Usually, in the case where a pigment is used in the colorant for magenta, the pigment has good light resistance property, but does not demonstrate sufficient color tone and transparency. In order to improve these properties, it is desired that the pigment is finely dispersed in a variety of media. Unfortunately, it is difficult to form a sufficiently fine pigment in a toner produced by a toner production process, and uniformly disperse the pigment.

Meanwhile, in the case where a dye is used in the colorant for magenta, the dye demonstrates a vivid magenta color in the initial period. The dye, however, has low light resistance property, and color nuance tends to greatly change after the dye is left under an ambient light. Moreover, in the case of a light color, a bright and sharp image is obtained. In a region of a dark color, however, a sufficient image density is difficult to obtain. Particularly, in the case where the colors are mixed and a dark red color and a dark blue color are reproduced, the range of the color to be reproduced is likely to be narrower. The xanthene colorant is a colorant having good color reproducibility and color tone, but the light resistance properties is significantly reduced when the colorant is used in a liquid form. Accordingly, various measures are needed (see Patent Literatures 1 and 2). Additionally, along with higher functions of the color multifunction machine these days, in order to obtain an image that satisfies the transparency and is closer to the manuscript, a magenta toner having further improved color tone, saturation, and electrophotographic properties is strongly desired.

CITATION LIST

Patent Literature

PTL 1: Japanese Patent Application Laid-Open No. H09-255882

PTL 2: Japanese Patent Application Laid-Open No. H05-117536

SUMMARY OF INVENTION

Technical Problem

An object of the present invention is to solve the problems above. Namely, an object of the present invention is to provide a magenta toner having high dispersibility of a colorant and good spectral characteristics. Another object of the present invention is to provide a magenta toner having high granulating properties when a toner is produced.

Solution to Problem

The objects are achieved by the invention below.

Namely, the present invention is a magenta toner including at least a binder resin, a compound represented by a formula (1), and a colorant, wherein the colorant includes a magenta toner particle containing a pigment having a quinacridone skeleton, and a method for producing the magenta toner.

Formula (1)

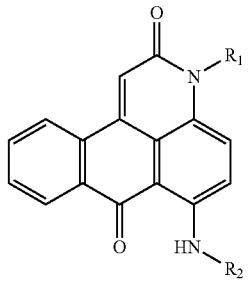

(wherein $R_1$ and $R_2$ each independently represents a hydrogen atom, an alkyl group, an aryl group, or an aralkyl group.)

Advantageous Effects of Invention

The present invention can provide a magenta toner having high dispersibility of a colorant and good spectral characteristics.

Further features of the present invention will become apparent from the following description of exemplary embodiments with reference to the attached drawings.

DESCRIPTION OF EMBODIMENTS

Figure 1:
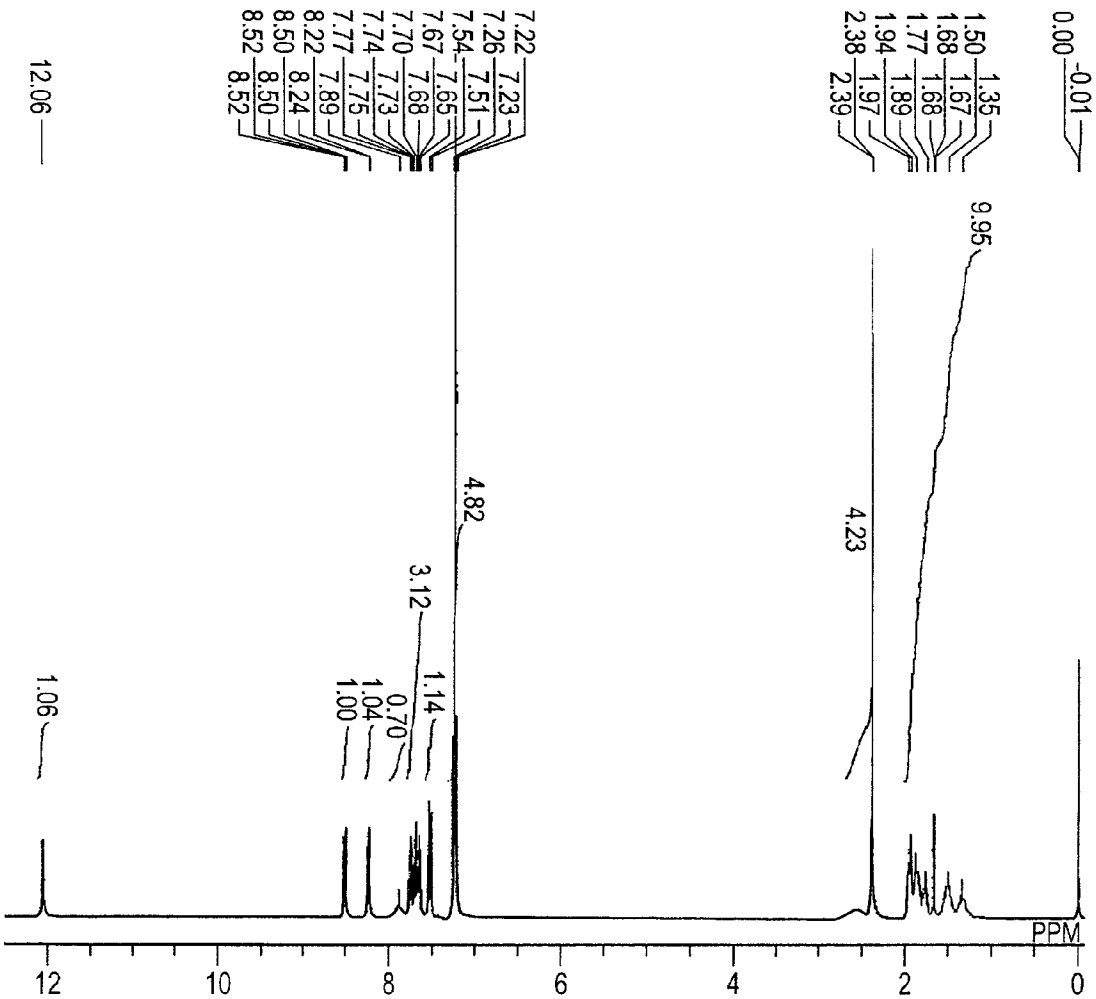
FIG. 1 is a drawing illustrating $^1$H NMR spectrum of a compound (15) represented by the formula (1) in $CDCl_3$ at room temperature and 400 MHz according to the present invention.

Hereinafter, the present invention will be described more in detail using embodiments.

As a result of extensive research in order to solve the problems in the related art, the present inventors found out that the problems can be solved by a magenta toner including magenta toner particles, each of which includes a binder resin, a compound represented by a formula (1), and a colorant, wherein the colorant includes a pigment having a quinacridone skeleton.

Formula (1)

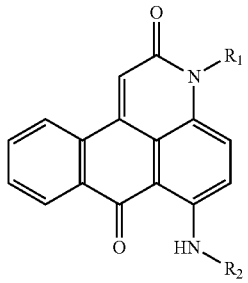

(wherein $R_1$ and $R_2$ each independently represent a hydrogen atom, an alkyl group, an aryl group, or an aralkyl group.)

The alkyl group of $R_1$ and $R_2$ in the formula (1) is not particularly limited, and examples thereof include a linear, branched, or cyclic alkyl group having 1 to 20 carbon atoms such as methyl, butyl, octyl, dodecyl, nonadecyl, cyclobutyl, cyclopentyl, cyclohexyl, methylcyclohexyl, or ethylhexyl.

The aryl group of $R_1$ and $R_2$ in the formula (1) is not particularly limited, and examples thereof include 6- to 14-membered monocyclic or polycyclic aryl groups such as phenyl or naphthyl.

The aralkyl group of $R_1$ and $R_2$ in the formula (1) is not particularly limited, and examples thereof include a benzyl group or a phenethyl group.

Further, $R_1$ and $R_2$ may have a substituent, which is not particularly limited as long as it does not significantly inhibit stability of the compound. Examples of the substituent include alkoxy groups such as methoxy, ethoxy, and butoxy; monosubstituted amino groups such as methylamino and propylamino; and disubstituted amino groups such as dimethylamino, dipropylamino, or N-ethyl-N-phenyl. In the case where $R_1$ and $R_2$ are an aryl group, an alkyl group such as methyl, ethyl, propyl, and butyl may be contained as another substituent.

$R_1$ is preferably an alkyl group or an aryl group, and more preferably a methyl group, a n-butyl group, a cyclohexyl group, a 2-ethylhexyl group, and a 4-methylphenyl group in order to improve the dispersibility.

The compound represented by formula (1) according to the present invention is commercially available, or can be synthesized by a known method.

One embodiment of a method for producing the compound represented by formula (1) according to the present invention will be shown, but the production method will not be limited to this.

Namely, Compound B can be obtained by acetylating Compound A with acetic anhydride. Further, Compound B is cyclized to obtain Compound C. Compound C and an amine compound are condensed to obtain a compound represented by the formula (1) according to the present invention. Persons skilled in the art can properly select addition of a reaction such as known protection and deprotection reactions and hydrolysis in the functional groups of the respective compounds when necessary.

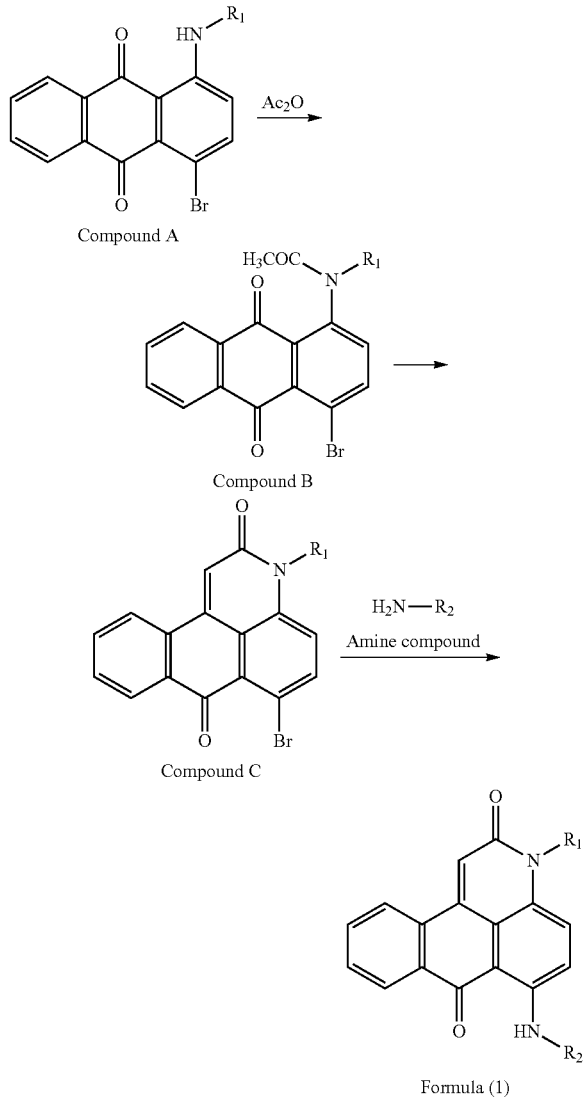

In the present invention, the pigment having a quinacridone skeleton can be represented by the formula (2):

Formula (2)

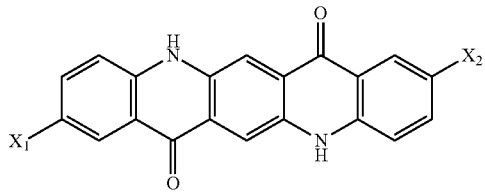

(wherein $X_1$ and $X_2$ each independently represent a hydrogen atom, an alkyl group, or a halogen atom.)

The alkyl group of $X_1$ and $X_2$ in the formula (2) is not particularly limited, and examples thereof include a linear, branched, or cyclic alkyl group having 1 to 20 carbon atoms such as methyl, butyl, octyl, dodecyl, nonadecyl, cyclobutyl, cyclopentyl, cyclohexyl, methylcyclohexyl, or ethylhexyl. Particularly preferred is methyl.

Examples of the halogen atom of $X_1$ and $X_2$ in the formula (2) include a fluorine atom, a chloro atom, a bromo atom, and an iodine atom.

As the pigment represented by the formula (2), preferred are C.I. Pigment Red 122, C.I. Pigment Red 202, and C.I. Pigment Violet 19.

The pigment having a quinacridone skeleton can be used alone, or can be used in combination with two or more of known magenta pigments or dyes.

Next, the toner according to the present invention will be described.

The toner according to the present invention includes a toner particle containing at least a binder resin, the compound represented by the formula (1), and the colorant containing a pigment having a quinacridone skeleton.

Examples of the binder resin used for the toner particle that forms the toner according to the present invention include styrene-methacrylic acid copolymers, styrene-acrylic acid copolymers, polyester resins, epoxy resins, and styrene-butadiene copolymers usually used. A monomer for forming these is used in a method for directly a toner particle by polymerization. Specifically, preferably used are styrene monomers such as styrene, α-methylstyrene, α-ethylstyrene, o-methylstyrene, m-methylstyrene, p-methylstyrene, o-ethylstyrene, m-ethylstyrene, and p-ethylstyrene; methacrylic acid ester monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl-methacrylate, dimethylaminoethyl methacrylate, diethylaminoethyl methacrylate, methacrylonitrile, and methacrylic acid amide; acrylic acid ester monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylic acid amide; and olefin monomers such as butadiene, isoprene, and cyclohexene. These are used alone, or usually, monomers are properly mixed and used such that the logical glass transition temperature (Tg) described in Polymer Handbook The second edition III, p.p. 139 to 192 (published by John Wiley & Sons) is 40 to 75° C. At a logical glass transition temperature less than 40° C., problems are likely to occur in storage stability, and durable stability of the toner. Meanwhile, at a logical glass transition temperature more than 75° C., the transparency of the image is reduced in the case of forming a full color image with the toner.

In the present invention, a polar resin such as polyester resins and polycarbonate resins can be used. For example, in the case where the toner is produced directly by a suspension polymerization method or the like, the polar resin is added during a polymerization reaction from a dispersing step to a polymerizing step. Thereby, control is enabled according to the balance between a polymerizable monomer composition as a toner base particle and the polarity of a water-based dispersion medium such that the added polar resin forms a thin layer on the surface of the toner base particle, or exists graded from the surface of the toner base particle toward the center thereof. At this time, if a polar resin interactive with the colorant according to the present invention or a charge control agent is used, a preferred state of the colorant existing in the toner can be provided.

In the present invention, in order to enhance mechanical strength of the toner particle and control the molecular weight of the toner molecule, a crosslinking agent can also be used during synthesis of the binder resin.

The crosslinking agent used in the toner particle that forms the toner according to the present invention is not particularly limited. Examples of bifunctional crosslinking agents include divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, polyester diacrylate, and those in which diacrylate is replaced by dimethacrylate.

The polyfunctional crosslinking agent is not particularly limited, and examples thereof include pentaerythritol triacrylate, trimethylolethane triacrylate, trimethylolpropane triacrylate, tetramethylolmethane tetraacrylate, oligoester acrylate and methacrylate thereof, 2,2-bis(4-methacryloxyphenyl)propane, diallyl phthalate, triallyl cyanurate, triallyl isocyanurate, and triallyl trimellitate.

The amount of these crosslinking agents to be used is preferably 0.05 to 10 parts by mass, and more preferably 0.1 to 5 parts by mass based on 100 parts by mass of the polymerizable monomer.

The pigment having a quinacridone skeleton is used in the toner particle that forms the toner according to the present invention. Other colorant can be used in combination as long as dispersibility of the pigment is not inhibited. Examples of the colorant usable in combination include compounds such as condensed azo compounds, anthraquinone compounds, azo metal complexes, methine compounds, and allylamide compounds.

Preferably, the toner particle that forms the toner according to the present invention contains wax. The wax is not particularly limited, and examples thereof include petroleum waxes and derivatives thereof such as paraffin wax, microcrystalline wax, and petrolatum; montan wax and derivatives thereof; hydrocarbon wax and derivatives thereof according to the Fischer-Tropsch method; polyolefin wax and derivatives thereof such as polyethylene; natural wax and derivatives thereof such as carnauba wax and candelilla wax. Examples of derivatives include oxides, block copolymers with a vinyl monomer, and graft modified products. Examples thereof also include alcohols such as higher aliphatic alcohols, fatty acids or compounds thereof such as stearic acid and palmitic acid, acid amides, esters, ketones, hard castor oil and derivatives thereof, plant waxes, and animal waxes. These can be used alone, or can be used in combination.

The total amount of the wax to be added is preferably in the range of 2.5 to 15.0 parts by mass, and more preferably 3.0 to 10.0 parts by mass based on 100 parts by mass of the binder resin.

In the toner according to the present invention, when necessary, a charge control agent can be mixed with the toner particle and used. Thereby, the frictional charge amount can be controlled to be optimal according to a developing system.

A known charge control agent can be used. Particularly preferred is a charge control agent having a high charging speed and capable of stably keeping a constant charging amount. Further, in the case where the toner is produced directly by the polymerization, particularly preferred is a charge control agent having low polymerization inhibiting properties and containing substantially no soluble substance in the water-based dispersion medium.

Examples of the charge control agent that controls and gives the toner a negative charge property include polymers or copolymers having a sulfonate group, a sulfonic acid salt group or a sulfonic acid ester group; salicylic acid derivatives and metal complexes; monoazo metal compounds; acetylacetone metal compounds; aromatic oxycarboxylic acids, aromatic mono- and polycarboxylic acids, metal salts thereof, anhydrides thereof, esters thereof; phenol derivatives such as bisphenols thereof; urea derivatives; metal-containing naphthoic acid compounds; boron compounds; quaternary ammonium salts; calixarenes; and resin charge control agents.

Examples of the charge control agent that controls and gives the toner a positive charge property include, nigrosine and nigrosine modified products with fatty acid metallic salts; guanidine compounds; imidazole compounds; quaternary ammonium salts such as tributylbenzylammonium-1-hydroxy-4-naphthosulfonic acid salts and tetrabutylammonium tetrafluoroborate, onium salts such as phosphonium salts that are analogs thereof, and lake pigments thereof; triphenylmethane dyes and lake pigments thereof (examples of a laking agent include phosphorus tungstate, phosphorus molybdate, phosphorus tungsten molybdate, tannic acid, lauric acid, gallic acid, ferricyan compounds, and ferrocyan compounds); metal salts of higher fatty acids; diorganotin oxides such as dibutyltin oxide, dioctyltin oxide, dicyclohexyltin oxide; diorganotin borates such as dibutyltin borate, dioctyltin borate, and dicyclohexyltin borate; and resin charge control agents. These can be used alone, or two or more thereof can be used in combination.

In the toner according to the present invention, an inorganic fine powder may be externally added to the toner particle as a fluidizing agent. As the inorganic fine powder, fine powders of silica, titanium oxide, alumina, multiple oxides thereof, and surface treated products thereof can be used.

Examples of the method for producing the toner particle that forms the toner according to the present invention include a crushing method, a suspension polymerization method, a suspension granulation method, and an emulsion polymerization method. From the viewpoint of environmental load during production and controllability of the particle size, among these production methods, particularly preferred are the suspension polymerization method, the suspension granulation method, and emulsion agglomeration in which granulation is performed in a water-based medium. The toner according to the present invention can be used for a developer used in liquid development (hereinafter, referred to as a liquid developer).

In order to enhance the dispersibility of the colorant in the toner particle, preferably, a state of colorant dispersion (masterbatch) in which the colorant is dispersed in a medium is provided in the production process of the toner particle.

The colorant dispersion can be obtained by dispersing at least the compound represented by the formula (1) and the pigment having a quinacridone skeleton in a dispersion medium.

0.01 to 10 parts by mass of the compound represented by the formula (1) can be used based on 100 parts by mass of the pigment having a quinacridone skeleton. The amount of the compound represented by the formula (1) to be used is preferably 0.05 to 10 parts by mass, and more preferably 0.1 to 5 parts by mass.

As the dispersion medium used for the colorant dispersion, an organic solvent or a water-based medium can be used according to the purpose and application.

As the organic solvent used for the colorant dispersion, a polymerizable monomer is preferably used. The polymerizable monomer is an addition polymerizable or condensation polymerizable monomer, and preferably an addition polymerizable monomer. Specifically, examples thereof can include styrene monomers such as styrene, o-methylstyrene, m-methylstyrene, p-methylstyrene, o-ethylstyrene, m-ethylstyrene, and p-ethylstyrene; acrylate monomers such as methyl acrylate, ethyl acrylate, propyl acrylate, butyl acrylate, octyl acrylate, dodecyl acrylate, stearyl acrylate, behenyl acrylate, 2-ethylhexyl acrylate, dimethylaminoethyl acrylate, diethylaminoethyl acrylate, acrylonitrile, and acrylic acid amide; methacrylate monomers such as methyl methacrylate, ethyl methacrylate, propyl methacrylate, butyl methacrylate, octyl methacrylate, dodecyl methacrylate, stearyl methacrylate, behenyl methacrylate, 2-ethylhexyl methacrylate, dimethylaminoethyl methacrylate, diethylaminoethyl methacrylate, methacrylonitrile, methacrylic acid amide; olefin monomers such as ethylene, propylene, butylene, butadiene, isoprene, isobutylene, and cyclohexene; halogenated vinyls such as vinyl chloride, vinylidene chloride, vinyl bromide, and vinyl iodide; vinyl esters such as vinyl acetate, vinyl propionate, and vinyl benzoate; vinyl ethers such as vinyl methyl ether, vinyl ethyl ether, vinyl isobutyl ether; and vinyl ketone compounds such as vinyl methyl ketone, vinyl hexyl ketone, and methyl isopropenyl ketone. Depending on applications, these can be used alone, or two or more thereof can be used in combination. In the case where the colorant dispersion according to the present invention is used in an application of a polymerized toner, among the polymerizable monomers, styrene or a styrene monomer is preferably used alone, or mixed with other polymerizable monomer and used. Particularly preferred is styrene because of easiness in handling.

The water-based medium used for the colorant dispersion means a medium mainly containing water as the component. Specific examples of the water-based medium include water itself and water to which an pH adjuster, a surfactant, or an organic solvent is added.

The colorant dispersion can be produced by a known dispersion method.

A dispersing machine used in the present invention is not particularly limited. For example, media dispersing machines such as rotary shear type homogenizers, ball mills, sand mills, and Attritors, and high pressure counter collision dispersing machines are preferably used.

Colorant Dispersion

Further, a resin may be added to the colorant dispersion. The resin usable for the colorant dispersion depends on the purpose and application, and is not particularly limited. Specifically, examples of the resin include polystyrene resins, styrene copolymers, polyacrylic acid resins, polymethacrylic acid resins, polyacrylic acid ester resins, polymethacrylic acid ester resins, acrylic acid copolymers, methacrylic acid copolymers, polyester resins, polyvinyl ether resins, polyvinyl methyl ether resins, polyvinyl alcohol resins, and polyvinyl butyral resins. These resins can be used alone, or two or more thereof can be used in combination.

<Method for Producing Toner by Suspension Polymerization Method>

The toner particle produced by the suspension polymerization method is produced as below, for example.

First, the colorant dispersion, the polymerizable monomer, and the like are mixed to prepare a polymerizable monomer composition. Next, the polymerizable monomer composition is dispersed in a water-based medium and granulated to produce droplets of a polymerizable monomer composition. The polymerizable monomer in the droplets is polymerized in the water-based medium to obtain a toner particle. The organic solvent contained in the colorant dispersion may be the same compound as the polymerizable monomer. Thus, the colorant dispersion using the organic solvent as the dispersion medium is prepared. Thereby, increase in the viscosity of the polymerizable monomer composition can be suppressed. Accordingly, a magenta toner is obtained in which handling in the toner production process is easy, the colorant has particularly high dispersibility, and the toner has a high coloring ability.

Examples of a polymerization initiator used in the suspension polymerization method can include known polymerization initiators, and include azo compounds, organic peroxide, inorganic peroxides, organic metal compounds, and photopolymerization initiators. More specifically, examples thereof include azo polymerization initiators such as 2,2'-azobis(isobutyronitrile), 2,2'-azobis(2-methylbutyronitrile), 2,2'-azobis(4-methoxy-2,4-dimethylvaleronitrile), 2,2'-azobis(2,4-dimethylvaleronitrile), and dimethyl-2,2'-azobis (isobutyrate); organic peroxide polymerization initiators such as benzoyl peroxide, di-tert-butyl peroxide, tert-butylperoxy isopropyl monocarbonate, tert-hexyl peroxy benzoate, and tert-butyl peroxy benzoate; inorganic peroxide polymerization initiators such as potassium persulfate and ammonium persulfate; and redox initiators such as hydrogen peroxide-ferrous initiators, BPO-dimethylaniline initiators, cerium (IV) salt-alcohol initiators. Examples of the photopolymerization initiator include acetophenone initiators, benzoin ether initiators, and ketal initiators. These methods can be used alone, or two or more thereof can be used in combination.

The concentration of the polymerization initiator is preferably in the range of 0.1 to 20 parts by mass, and more preferably 0.1 to 10 parts by mass based on 100 parts by mass of the polymerizable monomer. The kind of the polymerization initiator depends on the polymerization methods. The polymerization initiator is used alone, or mixed and used referring to a 10 hour half-life temperature.

The water-based medium used in the suspension polymerization method preferably contains a dispersion stabilizer. As the dispersion stabilizer, known inorganic and organic dispersion stabilizers can be used. Examples of the inorganic dispersion stabilizer include calcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica, and alumina. Examples of the organic dispersion stabilizer include polyvinyl alcohol, gelatin, methyl cellulose, methyl hydroxypropyl cellulose, ethyl cellulose, and sodium salt of carboxymethyl cellulose, and starch. Nonionic, anionic, and cationic surfactants can also be used. Examples thereof include sodium dodecyl sulfate, sodium tetradecyl sulfate, sodium pentadecyl sulfate, sodium octyl sulfate, sodium oleate, sodium laurate, potassium stearate, and calcium oleate.

Among the dispersion stabilizers, preferred is use of a less water-soluble inorganic dispersion stabilizer having solubility in an acid in the present invention. In the present invention, in the case where a less water-soluble inorganic dispersion stabilizer is used to prepare the water-based dispersion medium, these dispersion stabilizers are preferably used in a proportion of 0.2 to 2.0 parts by mass based on 100 parts by mass of the polymerizable monomer from the viewpoint of stability of the droplets of the polymerizable monomer composition in the water-based medium. In the present invention, 300 to 3,000 parts by mass of water based on 100 parts by mass of the polymerizable monomer composition is preferably used to prepare the water-based medium.

In the present invention, in the case where the water-based medium is prepared in which the less water-soluble inorganic dispersion stabilizer is dispersed, a commercially available dispersion stabilizer may be used as it is and dispersed. In order to obtain a dispersion stabilizer particle having a fine and uniform particle size, preferably, the less water-soluble inorganic dispersion stabilizer is produced in water under high speed stirring and prepared. For example, in the case where calcium phosphate is used as the dispersion stabilizer, a sodium phosphate aqueous solution is mixed with a calcium chloride aqueous solution under high speed stirring to form fine particles of calcium phosphate. Thereby, a preferred dispersion stabilizer can be obtained.

<Method for Producing Toner by Suspension Granulation Method>

A suitable toner particle can be obtained in the case where the toner particle according to the present invention is produced by the suspension granulation method. The production step in the suspension granulation method does not include a heating step. For this reason, the resin becoming compatible with the wax, which occurs when a low melting point wax is used, can be suppressed to prevent reduction in the glass transition temperature of the toner attributed to the compatibility. Moreover, the suspension granulation method has a wider choice of the toner materials for the binder resin. Usually, it is easy to use a polyester resin as the main component, the polyester resin being advantageous in fixing properties. For this reason, this is a production method advantageous in the case of production of a toner having a resin composition that cannot be used in the suspension polymerization method.

In the case where the toner particle is produced by the suspension granulation method, production is performed as follows, for example.

First, the colorant dispersion using an organic solvent as the dispersion medium, the binder resin, the wax, and the like are mixed in the solvent to prepare a solvent composition. Next, the solvent composition is dispersed in the water-based medium and granulated to obtain a particle suspension of the solvent composition. Then, the solvent can be removed from the particle to obtain a toner particle. The solvent can be removed by heating the suspension or reducing the pressure of the suspension.

Preferably, the solvent composition in the step is prepared by dispersing the colorant in a first solvent to obtain a dispersion liquid (colorant dispersion), and mixing the dispersion liquid with a second solvent. Namely, the colorant containing the pigment composition according to the present invention is sufficiently dispersed in the first solvent, and the obtained dispersion liquid is mixed with the second solvent together with other toner materials. Thereby, the pigment can exist in a good dispersion state in the toner particle.

Thus, the colorant dispersion using the organic solvent as the dispersion medium is prepared. Thereby, increase in the viscosity of the solvent composition can be suppressed. Accordingly, a magenta toner is obtained in which handling in the toner production process is easy, the colorant has particularly high dispersibility, and the toner has a high coloring ability.

Examples of the solvent usable in the suspension granulation method include hydrocarbons such as toluene, xylene, and hexane; halogen-containing hydrocarbons such as methylene chloride, chloroform, dichloroethane, trichloroethane, and carbon tetrachloride; alcohols such as methanol, ethanol, butanol, and isopropyl alcohol; polyhydric alcohols such as ethylene glycol, propylene glycol, diethylene glycol, and triethylene glycol; cellosolves such as methyl cellosolve and ethyl cellosolve; ketones such as acetone, methyl ethyl ketone, and methyl isobutyl ketone; ethers such as benzyl alcohol ethyl ether, benzyl alcohol isopropyl ether, and tetrahydrofuran; and esters such as methyl acetate, ethyl acetate, and butyl acetate. These can be used alone, or two or more thereof can be mixed and used. Among these, in order to easily remove the solvent in the toner particle suspension, preferred is a solvent having a low boiling point and being capable of sufficiently dissolving the binder resin.

The amount of the solvent to be used is preferably in the range of 50 to 5,000 parts by mass, and more preferably 120 to 1,000 parts by mass based on 100 parts by mass of the binder resin.

The water-based medium used in the suspension granulation method preferably contains a dispersion stabilizer. As the dispersion stabilizer, known inorganic and organic dispersion stabilizers can be used. Examples of the inorganic dispersion stabilizer include calcium phosphate, calcium carbonate, aluminum hydroxide, calcium sulfate, and barium carbonate. Examples of the organic dispersion stabilizer include water-soluble polymers such as polyvinyl alcohol, methyl cellulose, hydroxyethyl cellulose, ethyl cellulose, sodium salt of carboxymethyl cellulose, sodium polyacrylate, and sodium polymethacrylate; and surfactants, i.e., anionic surfactants such as sodium dodecylbenzenesulfonate, octadecyl sodium sulfate, sodium oleate, sodium laurate, and potassium stearate; cationic surfactants such as laurylamine acetate, stearylamine acetate, and lauryltrimethylammonium chloride; amphoteric surfactants such as lauryldimethylamine oxide; and nonionic surfactants such as polyoxyethylene alkyl ether, polyoxyethylene alkylphenyl ether, and polyoxyethylene-alkylamine.

The amount of the dispersant is preferably in the range of 0.01 to 20 parts by mass based on 100 parts by mass of the binder resin from the viewpoint of the stability of the droplet of the solvent composition in the water-based medium.

<Method for Producing Toner by Emulsion Agglomeration Method>

The toner particle produced by the emulsion agglomeration method is produced as follows, for example.

First, the colorant dispersion using a water-based medium as the dispersion medium and a resin particle are dispersed in the water-based medium to prepare a resin particle dispersion liquid. When necessary, a wax particle is dispersed in a water-based medium to prepare a wax particle dispersion liquid. The dispersion liquids prepared are mixed with each other to obtain a mixed solution (dispersing step). Next, the particles contained in the mixed solution prepared in the step above are aggregated to form aggregate particles (aggregation step), and the aggregate particles are heated and fused (fusing step). The fused particles are filtered, washed, and dried to obtain a toner particle.

The water-based medium in the dispersing step means a medium mainly containing water as the component. Specific examples of the water-based medium include water itself and water to which a pH adjuster, a surfactant, or an organic solvent is added.

The resin that forms the resin particle contained in the resin particle dispersion liquid is not particularly limited as long as it is a resin suitable for the binder resin for the toner.

The resin particle dispersion liquid is prepared by a known method. For example, in the case of a resin particle dispersion liquid containing a resin particle including a vinyl monomer, particularly a styrene monomer, a resin particle dispersion liquid can be prepared by performing emulsion polymerization on the monomer using a surfactant or the like. In the case of a resin produced by other method (for example, polyester resin), a resin particle dispersion liquid can be produced as follows. The resin is dissolved in an organic solvent having relatively low solubility in water to prepare a resin solution. The resin solution is put in a water-based medium together with an ionic surfactant and a polymer electrolyte, and fine droplets of the resin solution are produced by a dispersing machine such as a homogenizer. Then, the organic solvent is vaporized by heating or reducing pressure. Alternatively, the resin particle dispersion liquid may be prepared by a phase inversion emulsion method or a method in which a surfactant is added to the resin, and the mixture is subjected to emulsion dispersion in water by a dispersing machine such as a media dispersing machine such as a homogenizer, a ball mill, a sand mill, and an Attritor, or a high pressure counter collision dispersing machine.

In production of the resin particle dispersion liquid, the binder resin, the colorant, and the compound represented by the formula (1) are prepared at the same time in advance, and dispersed in a water-based medium. Thereby, a resin particle dispersion liquid containing the colorant can be produced.

Specific examples of the surfactant include water-soluble polymers such as polyvinyl alcohol, methyl cellulose, carboxymethyl cellulose, and sodium polyacrylate; surfactants, i.e., anionic surfactants such as sodium dodecylbenzenesulfonate, octadecyl sodium sulfate, sodium oleate, sodium laurate, and potassium stearate; cationic surfactants such as laurylamine acetate and lauryltrimethylammonium chloride; amphoteric surfactants such as lauryldimethylamine oxide; and nonionic surfactants such as polyoxyethylene alkyl ether, polyoxyethylene alkylphenyl ether, and polyoxyethylene-alkylamine; and inorganic compounds such as tricalcium phosphate, aluminum hydroxide, calcium sulfate, calcium carbonate, and barium carbonate. These can be used alone, or when necessary, two or more thereof can be used in combination.

From the viewpoint of washability in a post step, the molecular weight of the surfactant is preferably not more than 10,000, and more preferably not more than 5,000. Meanwhile, from the viewpoint of the surface activity, the molecular weight is preferably not less than 100, and more preferably not less than 200.

The amount of the surfactant is 0.01 to 10 parts by mass, preferably 0.1 to 5.0 parts by mass, and particularly more preferably 0.5 to 3.0 parts by mass based on 100 parts by mass of the resin particle from the viewpoint of the washability of the surfactant in the post step.

The median particle size of the resin particle based on the volume in the resin particle dispersion liquid is preferably 0.005 to 1.0 μm, and more preferably 0.01 to 0.4 μm from the viewpoint of the aggregation properties of the respective particles and the granulating properties of the toner base particle.

The average particle size of the resin particle can be measured, for example, using a dynamic light scattering (DLS) method, a laser light scattering method, centrifugation, a field-flow fractionation method, or an electrical sensing zone method. The average particle size in the present invention means a 50% cumulative particle size value based on the volume (D50) measured at 20° C. and the concentration of the solid content of 0.01% by mass by a dynamic light scattering (DLS)/laser doppler method, as described later, unless otherwise specified.

The wax dispersion liquid used in the dispersing step is prepared by a known method.

When necessary, other toner component may be mixed with the colorant dispersion, the resin particle dispersion liquid, and the wax dispersion liquid.

A method for forming an aggregate particle in the aggregation step is not particularly limited. Suitably used is a method in which a pH adjuster, a flocculant, a stabilizer, and the like are added to and mixed with the mixed solution, and a temperature is properly raised, or a mechanical force (stirring) is properly applied.

The pH adjuster is not particularly limited, and examples thereof include alkalis such as ammonia and sodium hydroxide and acids such as nitric acid and citric acid.

Examples of the flocculant include surfactants having a polarity opposite to that of the surfactant used to disperse the particle; inorganic metal salts such as sodium chloride, magnesium carbonate, magnesium chloride, magnesium nitrate, magnesium sulfate, calcium chloride, and aluminum sulfate; and metal complexes having a valence of 2 or more.

Examples of the stabilizer mainly include the surfactants above or a water-based medium containing these.

Usually, the average particle size of the aggregate particle formed here is preferably substantially the same as that of the toner particle to be obtained. In order to prevent fusing between the aggregate particles, the pH adjuster, the surfactant, and the like can be properly used.

In the fusing step, the aggregate particle is heated to be fused and coalesced. Thus, a toner particle is formed. The heating temperature may be a temperature between the glass transition temperature (Tg) of the resin contained in the aggregate particle and the decomposition temperature of the resin. For example, under stirring similar to that in the aggregation step, progression of the aggregation is stopped by addition of the surfactant or adjustment of the pH, and the resin contained in the resin particle is heated to a temperature not less than the glass transition temperature thereof. Thereby, the aggregate particle is fused and coalesced. The heating time may be a time during which the aggregate particle is sufficiently fused. Specifically, the heating may be performed approximately for 10 minutes to 10 hours.

Before and after the fusing step, a fine particle dispersion liquid having fine particles dispersed is added and mixed, and the fine particles are applied onto the surface of the aggregate particle. Thus, a toner particle having a core-shell structure can be formed.

The suspension containing the toner particle obtained in the fusing step is filtered, washed, and dried on a proper condition. Thereby, a toner particle can be obtained. In this case, in order to ensure sufficient charging properties as the toner, preferably, the toner particle is sufficiently washed.

The washing step and the drying step are the same as those in the case where the toner particle is produced by the suspension polymerization method.

The magenta toner according to the present invention produced by any of the various production methods preferably has a weight average particle size D4 of 4.0 to 9.0 μm. The ratio of the weight average particle size D4 to the number average particle size D1 (hereinafter, also referred to as weight average particle size D4/number average particle size D1 or D4/D1) is preferably not more than 1.35. Further, the weight average particle size D4 is preferably 4.9 to 7.5 μm, and the weight average particle size D4/number average particle size D1 is preferably not more than 1.30. In the value of the weight average particle size D4, if the proportion of the particle size less than 4.0 μm is increased, it is difficult to attain charging stability when the toner is used in an electrophotographic developing system. For this reason, degradation of an image such as image fogging and developing stripes is likely to occur in an operation in which a large amount of sheets is continuously developed (durable operation). This tendency is remarkable particularly in the case where fine powder of not more than 2.5 μm is increased. If the proportion of the toner particle having a weight average particle size D4 more than 8.0 μm is increased, reproductivity of a halftone portion is significantly reduced. As a result, the obtained image is a rough image, and not preferable. The tendency is remarkable particularly when coarse powder of not less than 10.0 μm is increased. If the weight average particle size D4/number average particle size D1 is more than 1.35, fogging and transfer properties are reduced, and the line width of a thin line greatly fluctuates (hereinafter, referred to as reduction in sharpness).

In the magenta toner according to the present invention, the weight average particle size D4 and the number average particle size D1 are adjusted by a method depending on the method for producing a toner particle. For example, in the case of the suspension polymerization method, D4 and D1 can be adjusted by controlling the concentration of the dispersant used in preparation of the water-based dispersion medium, the reaction stirring rate, or the reaction stirring time.

In the magenta toner according to the present invention, preferably, the average circularity of the magenta toner measured by a flow type particle image analyzer is 0.950 to 0.995, and more preferably 0.960 to 0.990 because the transfer properties of the toner are significantly improved.

The magenta toner according to the present invention may be any of a magnetic toner and a non-magnetic toner. In use as the magnetic toner, a magnetic material may be mixed with the toner particle that forms the toner according to the present invention, and used. Examples of such a magnetic material include iron oxides such as magnetite, maghemite, and ferrite; or iron oxides containing other metal oxide; and metals such as Fe, Co, and Ni, alloys of these metals and a metal such as Al, Co, Cu, Pb, Mg, Ni, Sn, Zn, Sb, Be, Bi, Cd, Ca, Mn, Se, Ti, W, and V, and a mixture thereof.

<Method for Producing Liquid Developer>

The liquid developer is produced as follows, for example.

To obtain the liquid developer according to the present invention, the colorant, the compound represented by the formula (1), the dispersant resin used as the dispersant, and when necessary, aids such as a charge control agent and wax are dispersed or dissolved in an electrically insulating carrier solution to produce a liquid developer. Alternatively, the liquid developer may be prepared by a two-stage method in which a condensed toner is produced in advance, and diluted with an electrically insulating carrier solution to prepare a developer.

The dispersing machine used in the present invention is not particularly limited. For example, preferably used are a media dispersing machine such as a rotary shear type homogenizer, a ball mill, a sand mill, and an Attritor, and a counter collision dispersing machine.

In the presence of the compound represented by the formula (1), the colorant used in the present invention can be used alone, two or more thereof can be used in combination. Alternatively, the colorant can be used in combination with two or more of known magenta pigments and dyes.

The resin and wax used in the present invention are the same as above.

The charge control agent using the present invention is not particularly limited and is any charge control agent used for the liquid developer for electrostatic development. Examples thereof include cobalt naphthenate, copper naphthenate, copper oleate, cobalt oleate, zirconium octylate, cobalt octylate, sodium dodecylbenzenesulfonate, calcium dodecylbenzenesulfonate, soy lecithin, and aluminum octoate.

The electrically insulating carrier solution used in the present invention is not particularly limited. For example, preferred is use of an organic solvent having a high electric resistance of not less than $10^9$ Ω·cm and a low permittivity of not more than 3.

Specific examples of preferable electrically insulating carrier solutions include aliphatic hydrocarbon solvents such as hexane, pentane, octane, nonane, decane, A1undecane, and dodecane; and those having a boiling point of 68 to 250° C.

such as ISOPARS H, G, K, L, and M (made by Exxon Chemical Company); LINEALENE Dimers A-20 and A-20H (made by Idemitsu Kosan Co. Ltd.). These may be used alone, or two or more thereof may be used in combination in the range in which the viscosity of the system is not increased.

EXAMPLES

Hereinafter, the present invention will be described more in detail using Examples and Comparative Examples, but the present invention will not be limited to these Examples. Herein, "parts" and "%" are based on mass unless otherwise specified. The obtained reaction products were identified by a plurality of analysis methods using the apparatuses below. Namely, the analyzers used were a $^{1}H$ and $^{13}C$ nuclear magnetic resonance spectrometer (ECA-400, made by JEOL, Ltd.), and an LC/TOF MS (LC/MSD TOF, made by Agilent Technologies). Ionization in the LC/TOF MS used was electrospray ionization (ESI).

[Production of Compound Represented by Formula (1)]

The compound represented by the formula (1) according to the present invention is commercially available, or can be synthesized by a known method.

The compound represented by the formula (1) according to the present invention was produced by a method described below.

Production Example 1

Production Example of Compound (15)

102 g of acetic anhydride was placed in a 20 g 1,2-dichlorobenzene solution of 76.9 g of 4-bromo-1-cyclohexylaminoanthraquinone, and 1 g of concentrated sulfuric acid was placed to the solution. The solution was stirred at 110° C. for 6 hours. After the reaction was completed, the solution was diluted with 1000 g of methanol and filtered to obtain 59.8 g of 1-(acetylcyclohexylamino)-4-bromoanthraquinone (yield of 70.1%). Further, a solution of 12 g of sodium hydroxide/150 g of water was dropped to a 150 g isobutanol solution of 1-(acetylcyclohexylamino)-4-bromoanthraquinone, and the obtained solution was stirred at 90° C. for 6 hours. After the reaction was completed, the solution was cooled, the obtained solid was filtered to obtain 28.7 g of 4-bromo1,9-N-cyclohexylanthrapyridone (70.4%). Next, 19.3 g of 4-methylanilinehexylamine, 8.6 g of sodium carbonate, and 6.8 g of copper powder were placed in a 40 g 1,3-dimethyl-2-imidazolidine solution of 20.4 g of 4-bromo1,9-N-cyclohexylanthrapyridone, and the reaction was made at 190° C. for 4 hours. After the reaction was completed, the solution was cooled, diluted with ethyl acetate, and filtered. Column chromatography refining (toluene/THF) was performed to obtain 17.6 g of a compound (15) (yield of 85.0%).

<Result of Analysis of Compound (15)>

[1] $^{1}H$ NMR (400 MHz, $CDCl_3$, room temperature): δ[ppm]=1.35-1.97 (m, 10H), 2.37 (s, 3H), 2.37-2.54 (br, 1H), 7.23 (dd, 4H, 14.4, 8.93 Hz), 7.52 (d, 1H, J=9.62 Hz), 7.65-7.77 (m, 3 Hz), 7.89 (s, 1H), 8.23 (d, 1H, J=7.79 Hz), 8.51 (dd, 1H, J=7.79, 1.37 Hz), 12.1 (s, 1H)

[2] Mass spectrometry (ESI-TOF): m/z=433.1932 $(M-H)^{+}$

Production Example of Other Dye Compound

Other compounds shown in Table 1 below were synthesized by the method according to Production Example 1. The structures of these compounds were recognized in the same manner as in the case of the compound. "*" represents a bonding side of a substituent. FIG. 1 illustrates a $^{1}H$ NMR spectrum of the compound (15) in Table 1 in $CDCl_3$ at room temperature and 400 MHz.

TABLE 1

Structures of compounds represented by formula (1)

| Compound | $R_1$ | $R_2$ | λex |
|---|---|---|---|
| (1) | $CH_3$ | 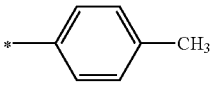 | 539 |
| (2) | $CH_3$ | 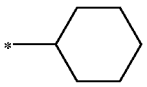 | 550 |
| (3) | $CH_3$ | 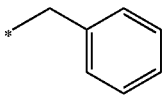 | 538 |
| (4) | $CH_3$ | 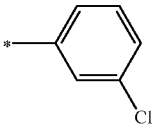 | 534 |
| (5) | $CH_3$ | 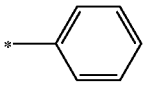 | 538 |

TABLE 1-continued
| Structures of compounds represented by formula (1) | | | |
|---|---|---|---|
| Compound | $R_1$ | $R_2$ | λex |
| (6) | $CH_3$ | 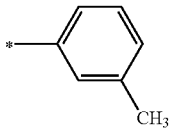 | 540 |
| (7) | $CH_3$ | 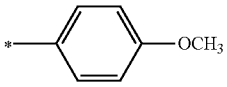 | 537 |
| (8) | $CH_3$ | 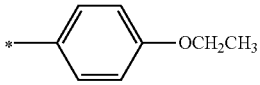 | 538 |
| (9) | $CH_3$ | 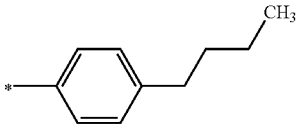 | 540 |
| (10) | $CH_3$ | 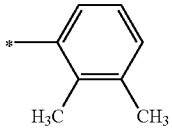 | 537 |
| (11) | $CH_3$ | 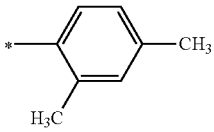 | 537 |
| (12) | $CH_3$ | 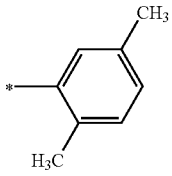 | 537 |
| (13) | $CH_3$ | 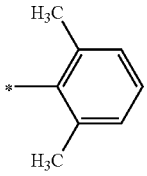 | 534 |
| (14) | $CH_3$ | 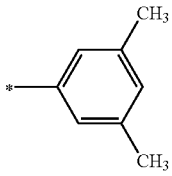 | 540 |
| (15) | 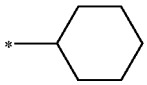 | 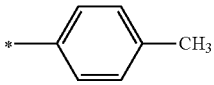 | 537 |
| (16) | n-Bu | 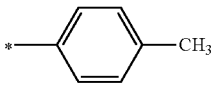 | 538 |

TABLE 1-continued

| Structures of compounds represented by formula (1) | | | |
|---|---|---|---|
| Compound | $R_1$ | $R_2$ | λex |
| (17) | 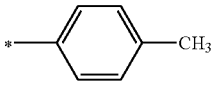 | 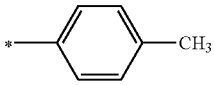 | 539 |
| (18) | 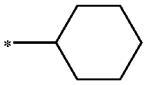 | 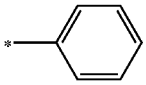 | 536 |
| (19) | 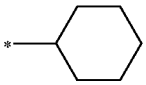 | 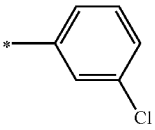 | 531 |
| (20) | 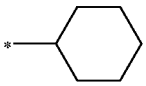 | 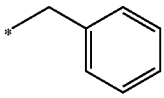 | 536 |
| (21) | 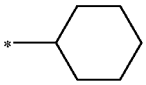 | 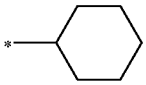 | 547 |
| (22) | n-Bu | 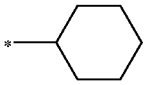 | 548 |
| (23) | n-Bu | 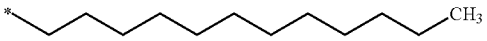 | 545 |

[Production of Magenta Toner]

The magenta toner according to the present invention and a magenta toner for comparison were produced by a method described below.

Example 1

A mixture of 0.6 parts of a compound (2), 12 parts of C.I. Pigment Red 122 (made by Clariant International Ltd., trade name "Toner Magenta E"), and 120 parts of styrene were dispersed by an Attritor (made by Mitsui Mining Co., Ltd.) for 3 hours to obtain a colorant dispersion (1) according to the present invention.

710 parts of ion exchange water and 450 parts of a 0.1 mol/L trisodium phosphate aqueous solution were added to a 2-L four-necked flask including a high speed stirrer T.K. homomixer (made by PRIMIX Corporation). The number of rotation was adjusted to 12,000 rpm, and the heating was performed to 60° C. 68 parts of a 1.0 mol/L calcium chloride aqueous solution was added to the flask little by little to prepare a water-based dispersion medium containing a fine less water-soluble dispersion stabilizer calcium phosphate.

| | |
|---|---|
| colorant dispersion (1) | 133.2 parts |
| styrene monomer | 46.0 parts |
| n-butylacrylate monomer | 34.0 parts |
| aluminum salicylate compound (made by ORIENT CHEMICAL INDUSTRIES CO., LTD., BONTRON E-88) | 2.0 parts |
| polar resin (polycondensate of propylene oxide-modified bisphenol A and isophthalic acid, Tg = 65° C., Mw = 10,000, Mn = 6,000) | 10.0 parts |

-continued

| | |
|---|---|
| ester wax (peak temperature of the largest endothermic peak in DSC measurement = 70° C., Mn = 704) | 25.0 parts |
| divinylbenzene monomer | 0.10 parts |

The formula was heated to 60° C., and uniformly dissolved and dispersed at 5,000 rpm using a T.K. homomixer. 10 parts of 2,2'-azobis(2,4-dimethylvaleronitrile) as the polymerization initiator was dissolved in the obtained solution to prepare a polymerizable monomer composition. The polymerizable monomer composition was put into the water-based medium, and granulated for 15 minutes while the number of rotation was kept at 12,000 rpm. Then, the high speed stirrer was replaced by a propeller stirring blade. The polymerization was continued at a temperature of the solution of 60° C. for 5 hours. Subsequently, the temperature of the solution was raised to 80° C., and the polymerization was continued for 8 hours. After the polymerization reaction was completed, the remaining monomer was removed at 80° C./under reduced pressure, and the temperature of the solution was cooled to 30° C. to obtain a polymer fine particle dispersion.

Next, the polymer fine particle dispersion was placed in a washing container. While the dispersion was stirred, diluted hydrochloric acid was added to adjust the pH to 1.5. Stirring was performed for 2 hours. Solid liquid separation was performed using a filter to obtain a polymer fine particle. Redispersion of the polymer fine particle in water and solid liquid separation were repeated until the compound of phosphoric acid and calcium containing calcium phosphate was sufficiently removed. Subsequently, the polymer fine particle subjected to solid liquid separation finally was sufficiently dried by a dryer to obtain a magenta toner particle (1).

Based on 100 parts of the obtained magenta toner particles, 1.00 part of hydrophobic silica fine powder surface treated with hexamethyldisilazane (number average size of the primary particle of 7 nm), 0.15 parts of rutile titanium oxide fine powder (number average size of the primary particle of 45 nm), and 0.50 parts of rutile titanium oxide fine powder (number average size of the primary particle of 200 nm) were dry mixed for 5 minutes by a Henschel mixer (made by NIPPON COKE & ENGINEERING CO., LTD.) to obtain a magenta toner according to the present invention (1).

Examples 2 to 4

Colorant dispersions (2) to (4) and magenta toners (2) to (4) were obtained by the same operation as in Example 1 except that the amount of the compound (2) to be used in Example 1 (mass amount thereof based on the pigment) was changed from 5% to 1%, 3%, or 10%.

Examples 5 to 10

Colorant dispersions (5) to (10) and magenta toners (5) to (10) were obtained by the same operation as in Example 1 except that the compound (2) in Example 1 was replaced by the compound represented by the formula (1) to (3), (5), (9), (15), (17), or (21) shown in Table 1.

Comparative Example 1

A colorant dispersion (11) for comparison and a magenta toner for comparison (11) were obtained by the same operation as in Example 1 except that the compound (2) in Example 1 was not used.

Comparative Examples 2 to 5

Colorant dispersions for comparison (12) to (15) and magenta toners for comparison (12) to (15) were obtained by the same operation as in Example 1 except that the compound (2) in Example 1 was replaced by the compounds for comparison (1) to (4) shown in Table 2.

Comparative Example 6

A colorant dispersion for comparison (16) and a magenta toner for comparison (16) were obtained by the same operation as in Example 1 except that the compound (2) in Example 1 was replaced by a commercially available dispersant Solsperse 24000SC (made by Lubrizol Japan Limited).

Example 11

90 parts of C.I. Pigment Red 122 (made by Clariant International Ltd., trade name "Toner Magenta E"), 10 parts of the compound (2) according to the present invention, and 15 parts of NEOGEN RK (made by Dai-ichi Kogyo Seiyaku Co., Ltd.) were mixed with 885 parts of ion exchange water, and dispersed for approximately 1 hour using a wet jet mill JN100 (made by Jokoh Co., Ltd.) to obtain a colorant dispersion (17). In the colorant dispersion, the median particle size based on the volume of the colorant particle (D50) was 0.2 μm, and the concentration of the colorant particle was 10% by mass.

82.6 parts of styrene, 9.2 parts of n-butyl acrylate, 1.3 parts of acrylic acid, 0.4 parts of hexanediol acrylate, and 3.2 parts of n-laurylmercaptan were mixed and dissolved. A 150 parts ion exchange water aqueous solution of 1.5 parts of NEOGEN RK (made by Dai-ichi Kogyo Seiyaku Co., Ltd.) was added to the solution, and dispersed. Further, while the solution was slowly stirred for 10 minutes, a 10 parts ion exchange water aqueous solution of 0.15 parts of potassium persulfate was added. After replacement with nitrogen, emulsion polymerization was performed at 70° C. for 6 hours. After the polymerization was completed, the reaction solution was cooled to room temperature, and ion exchange water was added. Thereby, a resin particle dispersion liquid (1) was obtained in which the concentration of the solid content was 12.5% by mass, and the median particle size based on the volume (D50) was 0.2 μm.

100 parts of ester wax (peak temperature of the largest endothermic peak in DSC measurement=70° C., Mn=704) and 15 parts of NEOGEN RK (made by Dai-ichi Kogyo Seiyaku Co., Ltd.) were mixed with 385 parts of ion exchange water, and dispersed for approximately 1 hour using a wet jet mill JN100 (made by Jokoh Co., Ltd.) to obtain a wax particle dispersion liquid (1). The concentration of the wax particle dispersion liquid was 20% by mass.

10 parts of the colorant dispersion (17), 160 parts of the resin particle dispersion liquid (1), 10 parts by mass of the wax particle dispersion liquid (1), and 0.2 parts of magnesium sulfate were mixed, and dispersed using a homogenizer (ULTRA-TURRAX T50, made by IKA Works GmbH & Co. KG). Then, while the solution was stirred, the heating was performed to 65° C. After stirring at 65° C. for 1 hour, the solution was observed by an optical microscope. It was found that an aggregate particle having the average particle size of approximately 6.0 μm was formed. 2.2 parts of NEOGEN RK (made by Dai-ichi Kogyo Seiyaku Co., Ltd.) was added, and the temperature was raised to 80° C., followed by stirring for 120 minutes. Thereby, a fused spherical toner base particle was obtained. After cooling, the solution was filtered, 720 parts of ion exchange water was added to the filtered solid content, and stir washing were performed for 60 minutes. The mixed solution containing the toner base particle was filtered. The same washing and filtration were repeated until the electric conductivity of the filtrate reached not more than 150 μS/cm. Finally, filtration was performed to filter out the solid. Subsequently, the solid was dried by a vacuum dryer to obtain a magenta toner particle (17).

The electric conductivity of the filtrate was calculated according to the method described in Japanese Patent Application Laid-Open No. 2006-243064. Namely, 30 parts of the initial filtrate was discarded, and the temperature of the remaining filtrate was raised to 25±0.5° C. Then, the filtrate was measured by an electric conductivity meter (ES-12, made by HORIBA, Ltd.), and the electric conductivity of the sample was calculated by the following equation:

$$\text{electric conductivity}[\mu S/cm]=A-B$$

A: electric conductivity of the filtrate

B: electric conductivity of water used for washing

The ion exchange water having an electric conductivity of not more than 5 μS/cm and a pH of 7.0±1.0 was used.

1.00 part of hydrophobic silica fine powder surface treated with hexamethyldisilazane (number average size of the primary particle of 7 nm), 0.15 parts of rutile titanium oxide fine powder (number average size of the primary particle of 45 nm), and 0.50 parts of rutile titanium oxide fine powder (number average size of the primary particle of 200 nm) were dry mixed with 100 parts of the obtained magenta toner particles (17) for 5 minutes by a Henschel mixer (made by NIPPON COKE & ENGINEERING CO., LTD.) to obtain a magenta toner (17).

Example 12

A colorant dispersion (18) and a magenta toner (18) were obtained in the same manner except that instead of the compound (2) in Example 11, the compound (15) represented by the formula (1) shown in Table 1 was used.

Example 13

Under a nitrogen gas atmosphere, 4.0 mol of terephthalic acid, 1.0 mol of isophthalic acid, and 0.04 mol of dibutyltin oxide were added to a mixed solution including 1.5 mol of a bisphenol A ethylene oxide 2 mol adduct, 1.8 mol of a bisphenol A trimethylene oxide 2 mol adduct, 1.1 mol of cyclohexane dimethanol, and 0.62 mol of ethylene glycol. While the mixed solution was stirred, the reaction was made at 195° C. for 6 hours. Further, the temperature was raised to 240° C., and the reaction was made for 6 hours. The pressured within the reaction container was reduced to 10.0 mmHg, and the reaction was made under reduced pressure for 0.5 hours. Thus, a light yellow transparent non-crystalline linear polyester resin (1) was obtained. In the obtained non-crystalline linear polyester resin (1), the Tg measured by the DSC method was 56° C., the Mw measured by a GPC method in terms of styrene was 11300, the Mn was 4400, and Mw/Mn was 2.6. The acid value measured using an acetone-toluene mixed solution according to JIS-K0070 was 12 mgKOH/g.

Next, C.I. Pigment Red 122 (made by Clariant International Ltd., trade name "Toner Magenta E"), the compound (2) according to the present invention, and the non-crystalline linear polyester resin (1) were dispersed using a dispersing machine that is a modified CAVITRON CD1010 (made by Eurotec, Ltd.) for high temperature and high pressure. Specifically, a mixture was prepared in the composition ratio of 79 parts of ion exchange water, 1 part of NEOGEN RK (made by Dai-ichi Kogyo Seiyaku Co., Ltd.), 0.9 parts of C.I. Pigment Red 122 (made by Clariant International Ltd., trade name "Toner Magenta E"), 0.1 parts of the compound (2) according to the present invention, and 20 parts of the non-crystalline linear polyester resin (1), and ammonia was added to the mixture to adjust the pH to 8.5. The mixture was subjected to operation by the CAVITRON under the condition of the rotational speed of a rotator of 60 Hz, the pressure of 5 kg/cm$^2$, and the heating temperature by a heat exchanger of 140° C. Thereby, a colorant dispersion (19) having a number average particle size of 290 nm was obtained.

160 parts of the obtained colorant dispersion (19), 10 parts of the wax particle dispersion liquid (1), and 0.2 parts of magnesium sulfate were dispersed using a homogenizer (ULTRA-TURRAX T50, made by IKA Works GmbH & Co. KG). Then, while stirring, the heating was performed to 65° C. After stirring at 65° C. for 1 hour, the obtained solution was observed by an optical microscope. It was recognized that an aggregate particle having an average particle size of approximately 6.0 μm was formed. After 2.2 parts of NEOGEN RK (made by Dai-ichi Kogyo Seiyaku Co., Ltd.) was added, the temperature was raised to 80° C., followed by stirring for 120 minutes. Thereby, a fused spherical toner base particle was obtained. After cooling and filtration, the filtered solid content was stir washed in 720 parts of ion exchange water for 60 minutes. The mixed solution containing the toner base particle was filtered. The washing and filtration were repeated until the electric conductivity of the filtrate reached not more than 150 μS/cm. By drying using a vacuum dryer, a magenta toner particle (19) was obtained.

1.00 part of hydrophobic silica fine powder surface treated with hexamethyldisilazane (number average size of the primary particle of 7 nm), 0.15 parts of rutile titanium oxide fine powder (number average size of the primary particle of 45 nm), and 0.50 parts of rutile titanium oxide fine powder (number average size of the primary particle of 200 nm) were dry mixed with 100 parts of the obtained magenta toner particles (19) for 5 minutes by a Henschel mixer (made by NIPPON COKE & ENGINEERING CO., LTD.) to obtain a magenta toner (19).

Comparative Example 7

A colorant dispersion for comparison (20) and a magenta toner for comparison (20) were obtained by the same operation as in Example 11 except that C.I. Pigment Red 122 (made by Clariant International Ltd., trade name "Toner Magenta E") in Production Example of the toner (11) was not used, and the amount of the compound (2) to be used was 100 parts.

[Evaluation]

The colorant dispersions and magenta toners were evaluated as follows.

<Evaluation of Dispersibility of Colorant Dispersion>

The dispersibility of the colorant dispersion was evaluated as follows. Using a particle size analyzer (Grind Meter) (TESTER SANGYO CO,. LTD.), the size of the particle of the pigment was measured, the dispersibility was determined.

A: less than 2.5 μm (dispersibility is very good)

B: not less than 2.5 μm and less than 4.5 μm (dispersibility is good)

C: not less than 4.5 μm (dispersibility is bad)

<Measurement of Viscosity of Colorant Dispersion>

The viscosity of colorant dispersion was evaluated as follows. The viscosity of colorant dispersion was measured by a rheometer PHYSICA MCR 300 (Paar Physica) and determined.

Cone plate measurement jig: diameter of 75 mm, 1° Shear rate: 10 $s^{-1}$

A: the viscosity is reduced by not less than 35% compared to that of the colorant dispersion for comparison (11)

B: the viscosity is reduced by not less than 10% and less than 35% compared to that of the colorant dispersion for comparison (11)

C: the viscosity is reduced by less than 10% compared to that of the colorant dispersion for comparison (11), or the viscosity is increased The colorant dispersion was developed on an aluminum substrate, and the solvent was naturally dried and removed. The thus-obtained sample was enlarged at a magnification of 50,000 times and observed by a scanning electron microscope S-4800 (made by Hitachi, Ltd.). Thereby, the dispersibility was checked.

<Measurement of Weight Average Particle Size D4 and Number Average Particle Size of Toner D1>

The granulating properties were evaluated and determined as follows. The number average particle size (D1) and weight average particle size (D4) of the toner particle were measured by a particle size distribution analysis according to the Coulter method. Using a Coulter Counter TA-II or a Coulter Multisizer II (made by Beckman Coulter, Inc.) as the measurement apparatus, the measurement was performed according to the operation manual of the apparatus. First grade sodium chloride was used as the electrolyte solution, an approximately 1% sodium chloride aqueous solution was prepared. For example, an ISOTON-II (made by Coulter Scientific Japan, K.K.) can be used. As a specific measurement method, 0.1 to 5 mL of a surfactant (preferably, alkylbenzenesulfonic acid salt) as a dispersant was added to 100 to 150 mL of the electrolytic aqueous solution, and 2 to 20 mg of the sample to be measured (toner particle) was added. The electrolyte solution having the sample suspended was dispersed by an ultrasonic disperser for approximately 1 to 3 minutes. Using the obtained dispersion solution, the volume and number of the toner having a particle size of not less than 2.00 μm were measured by the measurement apparatus to which an aperture of 100 μm was mounted. The volume distribution and number distribution of the toner were calculated. Then, the number average particle size (D1) and weight average particle size (D4) of the toner particle (the median in each channel was used as a representative value of each channel) were determined, and D4/D1 was calculated.

The channels used were 13 channels of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm, and 32.00 to 40.30 μm. Apparently from Table 2, it was found that the proportions of coarse powder and fine powder are reduced in Examples in the present invention compared to Comparative Examples.

The granulating properties were evaluated from the value of D4/D1.

A: less than 1.35 (granulating properties are very good)

B: not less than 1.35 and less than 1.60 (granulating properties are good)

C: not less than 1.60 (granulating properties are bad)

<Measurement of Average Circularity of Toner>

Measurement was performed using a flow type particle image measurement apparatus "FPIA-2100" (made by Sysmex Corporation), and the average circularity of the toner was calculated using the following equation:

$$\text{Equivalent circle diameter} = \sqrt{\text{Projected area of particle}/\pi} \times 2$$

$$\text{Circularity} = \frac{\text{Circumferential length of circle having the same area as projected area of particle}}{\text{Circumferential length of projected image of particle}}$$

Here, the "projected area of the particle" is an area of a binarized toner particle image, and the "circumferential length of the projected image of the particle" defines the length of the outline obtained by connecting edge points of the toner particle. The circularity is an index representing a degree of depressions and projections of the particle. It designates 1.000 when the particle has a perfect spherical shape, and the value of the circularity is smaller as the shape of the surface is more complicated.

The results of evaluation of Examples and Comparative Examples are shown in Tables 2-1 and 2-2.

TABLE 2-1

Evaluation of colorant dispersion and evaluation of toner (1)

| | | | | | Evaluation of colorant dispersion | | | | | Evaluation of toner | | | | | |
|---|---|---|---|---|---|---|---|---|---|---|---|---|---|---|---|
| Example | Toner No. | Colorant dispersion No. | Compound represented by formula (1) No. | % by weight in colorant dispersion | Particle gauge particle size [μm] | Evaluation of dispersibility | Viscosity [mPa · s] | Reduction rate of viscosity [%] | Evaluation of viscosity | D50 size [μm] | D4/D1 | Granulating properties | Average circularity | Proportion of particle size less than 2.52 [μm] [% by volume] | Proportion of particle size not less than 10.0 [μm] [% by volume] |
| Example 1 | (1) | (1) | 2 | 4.8 | 2.0 | A | 1040 | 50 | A | 6.36 | 1.27 | A | 0.988 | 1.8 | 1.3 |
| Example 2 | (2) | (2) | 2 | 1.0 | 2.3 | A | 1322 | 37 | A | 6.55 | 1.35 | A | 0.984 | 2.0 | 1.5 |
| Example 3 | (3) | (3) | 2 | 2.9 | 2.2 | A | 1134 | 46 | A | 6.12 | 1.34 | A | 0.982 | 1.5 | 1.2 |
| Example 4 | (4) | (4) | 2 | 9.1 | 2.5 | B | 1160 | 45 | A | 6.43 | 1.40 | B | 0.979 | 1.8 | 1.6 |
| Example 5 | (5) | (5) | 3 | 4.8 | 2.1 | A | 1065 | 49 | A | 6.21 | 1.53 | B | 0.974 | 2.4 | 1.3 |
| Example 6 | (6) | (6) | 5 | 4.8 | 2.1 | A | 1550 | 26 | B | 6.48 | 1.27 | A | 0.986 | 1.7 | 1.8 |
| Example 7 | (7) | (7) | 9 | 4.8 | 2.2 | A | 1432 | 32 | B | 5.99 | 1.27 | A | 0.973 | 1.6 | 0.9 |
| Example 8 | (8) | (8) | 15 | 4.8 | 2.0 | A | 1445 | 31 | B | 6.26 | 1.28 | A | 0.987 | 1.3 | 1.3 |
| Example 9 | (9) | (9) | 17 | 4.8 | 2.1 | A | 1320 | 37 | A | 6.36 | 1.27 | A | 0.985 | 1.2 | 1.3 |
| Example 10 | (10) | (10) | 21 | 4.8 | 2.2 | A | 1054 | 50 | A | 6.25 | 1.26 | A | 0.988 | 1.2 | 1.2 |
| Comparative Example 1 | (11) | (11) | Not added | | 30.0 | C | 2099 | Reference | | 6.60 | 1.69 | C | 0.953 | 6.1 | 3.5 |
| Comparative Example 2 | (12) | (12) | Compound for comparison (1) | 4.8 | 29.9 | C | 2100 | 0 | C | 6.85 | 1.69 | C | 0.950 | 5.9 | 4.0 |
| Comparative Example 3 | (13) | (13) | Compound for comparison (2) | 4.8 | 30.0 | C | 2863 | −36 | C | 6.75 | 1.72 | C | 0.955 | 5.4 | 3.8 |
| Comparative Example 4 | (14) | (14) | Compound for comparison (3) | 4.8 | 29.8 | C | 2134 | −2 | C | 6.60 | 1.69 | C | 0.956 | 5.7 | 3.7 |
| Comparative Example 5 | (15) | (15) | Compound for comparison (4) | 4.8 | 30.0 | C | 2076 | 1 | C | 6.77 | 1.69 | C | 0.953 | 5.5 | 3.8 |
| Comparative Example 6 | (16) | (16) | Solsperse 24000SC | 4.8 | 28.0 | C | 3213 | −53 | C | 6.17 | 1.73 | C | 0.961 | 6.3 | 3.4 |

TABLE 2-2

Evaluation of colorant dispersion and evaluation of toner (2)

| Example | Toner No. | Colorant dispersion No. | Compound represented by formula (1) No. | % by weight in colorant dispersion | Evaluation of colorant: Particle gauge particle size [μm] | Evaluation of colorant: Evaluation of dispersibility | Evaluation of toner: D50 size [μm] | D4/D1 | Granulating properties | Average circularity | Proportion of particle size less than 2.52 [μm] [% by volume] | Proportion of particle size not less than 10.0 [μm] [% by volume] |
|---|---|---|---|---|---|---|---|---|---|---|---|---|
| Example 11 | (17) | (17) | 2 | 10 | 2.2 | A | 6.13 | 1.21 | A | 0.995 | 1.2 | 1.2 |
| Example 12 | (18) | (18) | 15 | 10 | 2.4 | A | 5.98 | 1.23 | A | 0.996 | 2.0 | 3.5 |
| Example 13 | (19) | (19) | 2 | 10 | 2.0 | A | 6.52 | 1.19 | A | 0.995 | 2.0 | 2.9 |
| Comparative Example 7 | (20) | (20) | 2 | 100 | 24.2 | C | 6.60 | 2.16 | C | 0.868 | 3.3 | 9.2 |

Compound for comparison (1)

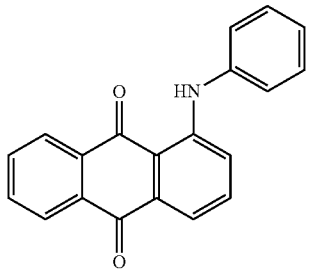

Compound for comparison (2)

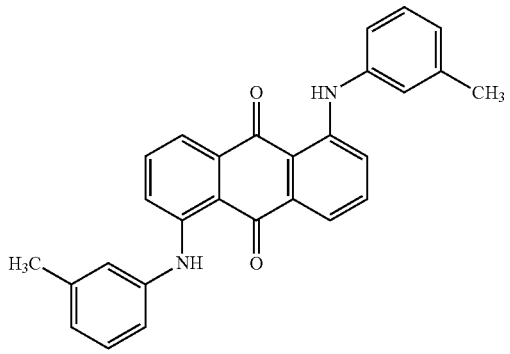

Compound for comparison (3)

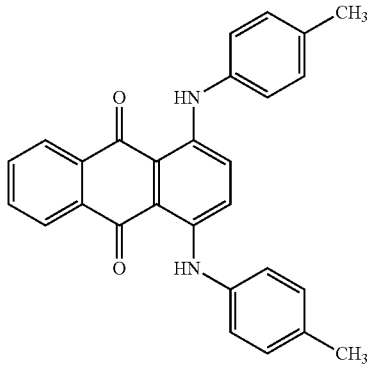

-continued

Compound for comparison (3)

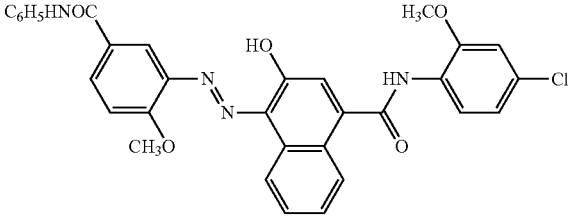

<Evaluation of Image Sample>

Next, using ten kinds of the magenta toners according to the present invention, an image sample was output, image properties described later were compared and evaluated. In comparison of the image properties, a modified LBP-5300 (made by Canon Inc.) was used as an image forming apparatus (hereinafter, abbreviated to the LBP), and a sheet feed durability test was performed. In the modified LBP-5300, a developing blade with in a process cartridge (hereinafter, referred to as a CRG) was replaced by an SUS blade having a thickness of 8 [μm]. Additionally, modification was made such that a blade bias of −200 [V] could be applied to a developing bias applied to a developing roller as a toner carrier.

In evaluation, each of the toners was individually filled into the CRG, and such CRGs were prepared for each of evaluation items. The LBP was set for each of the CRGs filled with each of the toners, and evaluation was made for each of evaluation items.

The toners were compared in three of image fogging, developing stripes, and sharpness as the evaluation items.

As an evaluation environment, among the following three environments:

1) a normal temperature and normal humidity environment (N/N (23° C., 55% Rh)): (hereinafter, abbreviated to the N/N environment)
2) a low temperature and low humidity environment (L/L (15° C., 10% Rh)): (hereinafter, abbreviated to the L/L environment)
3) a high temperature and high humidity environment (H/H (30° C., 80% Rh)): (hereinafter, abbreviated to the H/H environment)

the sharpness was evaluated only in the N/N environment. In the other two items, evaluation was made in the three environments.

The results are as shown in Table 3 described later. In the case where the toners according to the present invention were used, better results were obtained in each of the image evaluation items than in the case where the toners in Comparative Examples were used.

Hereinafter, a specific evaluation method in each of the evaluation items was shown.

<Image Fogging>

Image fogging indicates a phenomenon that the toner is deposited on a portion in which the toner should not be deposited (hereinafter, abbreviated to a blank portion). Accordingly, the image is better as the density of the blank portion is lower.

Particularly, in the case where the toner having a large proportion of fine power is used, the toner is likely to be fused onto the surface of the developing blade within the CRG. As a result, the toner not sufficiently charged is increased, producing the image fogging in a non-image region.

Then, in order to examine the image fogging, first, using a CRG undergoing the sheet feed durability test of 15,000 sheets, an image having the blank portion was output. Subsequently, using a "Digital White Light Photometer TC-6D" (made by Tokyo Denshoku Co., Ltd.), the whiteness of the blank portion in the image previously output (reflectance Ds [%]) was measured.

Additionally, the average whiteness (average reflectance Dr [%]) of the paper for evaluation shown below was measured, the paper belonging to the same production lot and being not subjected to image output. Then, from the difference between these, the fogging density [%] (=Dr [%]−Ds [%]) was calculated, and the image fogging in evaluation in the durability test was determined.

As the evaluation condition, a blue filter was used for evaluation. As the paper for evaluation, a (paper brand name) Image Coat Gross 128 (A4 size) (available from Canon Marketing Japan Inc.) was used.

The results of evaluation of fogging obtained under the condition above were evaluated based on the ranks described below.

In the toners using the colorant dispersion according to the present invention, A, B, and C represent a level having no problem in practical use. D and E levels are a level in which it is determined that the blank portion is reddish. Accordingly, it was determined that the C rank or higher is a preferred level.

A: less than 1.0 [%]

B: not less than 1.0 [%] and less than 2.0 [%]

C: not less than 2.0 [%] and less than 3.0 [%]

D: not less than 3.0 [%] and less than 4.0 [%]

E: not less than 4.0 [%]

<Developing Stripes>

Developing stripes represent a phenomenon that the toner is partially fused onto the surface of the developing blade to make the toner coating on the developing roller untidy, thereby producing stripe-like unevenness on the image. Accordingly, similarly to the image fogging, the developing stripes are likely to be increased as the proportion of fine powder is increased.

In order to check production of the developing stripes, used was an image in which an uniform toner image was formed on a paper for output every time when 1,000 sheets were output during the continuous sheet feed durability test of 15,000 sheets (hereinafter, referred to as a solid image and a halftone image). As the paper for evaluation, a (paper brand name) CS-814 (A4 size) (available from Canon Marketing Japan Inc.) was used.

The presence of the developing stripes was determined by visually observing the solid image and the halftone image. The evaluation ranks were based on the following determination criterion. The developing stripes can be visually checked. Accordingly, it was determined as a preferred level if the developing stripes did not occur until 12,000 sheets were output, in which a sufficiently margin could be ensured to the sheet number of durability in practical use in the LBP used here.

A: developing stripes does not occur until 15,000 sheets are output

B: developing stripes occur from 14,001 to 15,000 sheets

C: developing stripes occur from 12,001 to 14,000 sheets

D: developing stripes occur from 10,001 to 12,000 sheets

E: developing stripes occur before 10,000 sheets are output

<Sharpness>

Specifically, sharpness is an index indicating reproductivity of fine portions such as a thin line (for example, a 1-dot line in an image having an image resolution of 600 dpi). Accordingly, the reproductivity is more inferior as fine powder and coarse powder are mixed in a larger proportion in the toner particle size.

Figure 2:
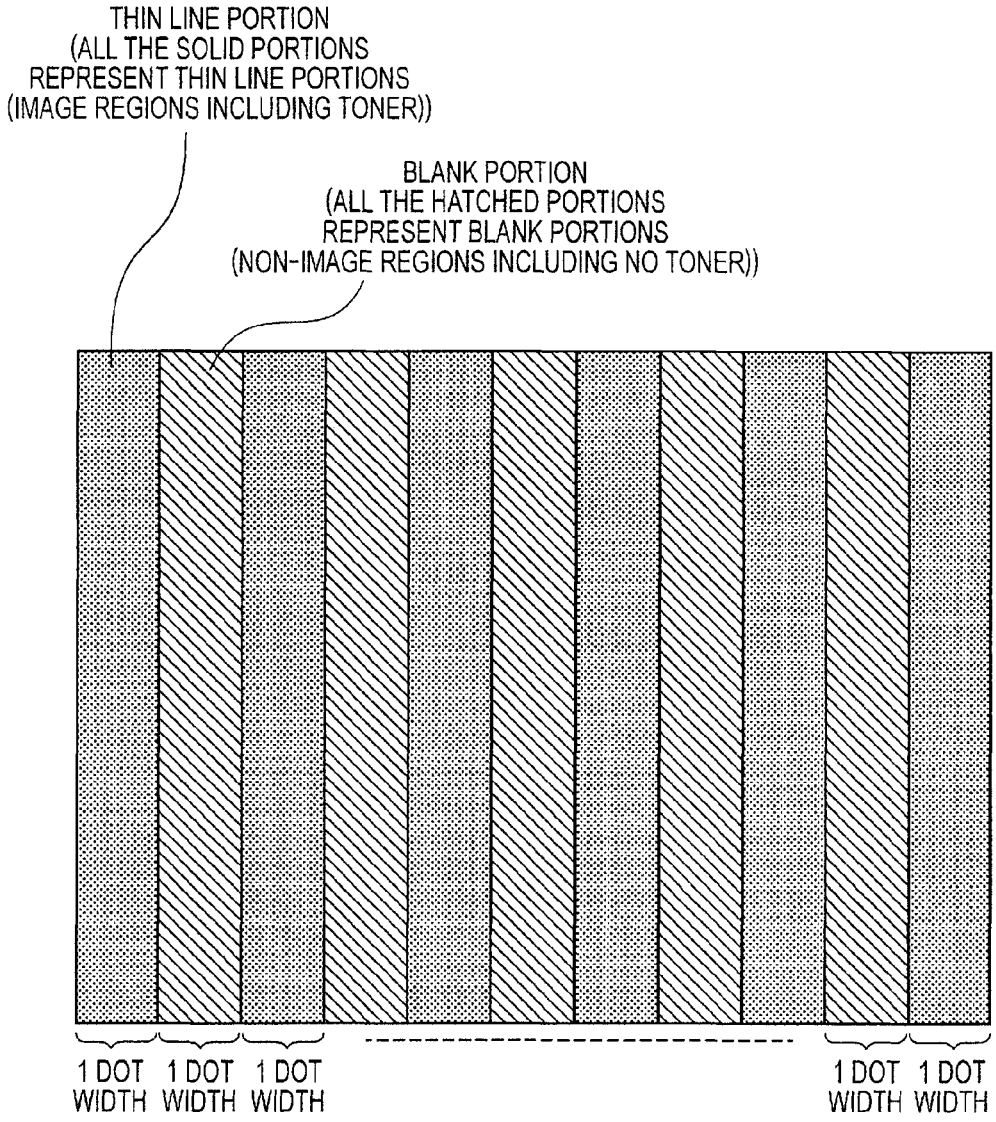
FIG. 2 is a drawing illustrating an example of a sharpness evaluation pattern.

Then, as a method for evaluating sharpness, first, an image pattern as illustrated in FIG. 2 is output by an LBP, the image including a thin line portion of a 1 dot width and a 1 dot blank portion (hereinafter, abbreviated to a 1 dot-1 space image) alternated and repeated.

The same paper for evaluation CS-814 (A4 size) as that used in the evaluation of the developing stripes was used for output. A uniform toner image having at least a 5 [cm] square is also output on the paper for output at the same time. Then, using a high resolution scanner Nexscan F4200 (made by Heidelberger Druckmaschinen AG), the output image is taken in at a resolution of 5080 dpi under the condition of 1024×1024 pixels.

From the scanner image taken in, fluctuation in the saturation of the 1 dot-1 space image (hereinafter, abbreviated to the saturation difference (A)) and the saturation difference between the blank portion and the solid uniform toner image portion in the paper for output (hereinafter, abbreviated to the saturation difference (B)) are calculated. The saturation (C*) here is defined using a* and b* expressed by the chromaticity value of CIE 1976 L*a*b* by the following equation:

$$=\sqrt{(a^*)^2+(b^*)^2}$$

Using the saturation difference, the sharpness is defined by the following equation:

$$\text{sharpness}=\text{saturation difference}(A)/\text{saturation difference}(B)$$

The saturation difference is smaller as the value of the sharpness is closer to 1. It can be said that the sharpness is higher. Then, the evaluation value was evaluated according to the following index.

Figure 3:
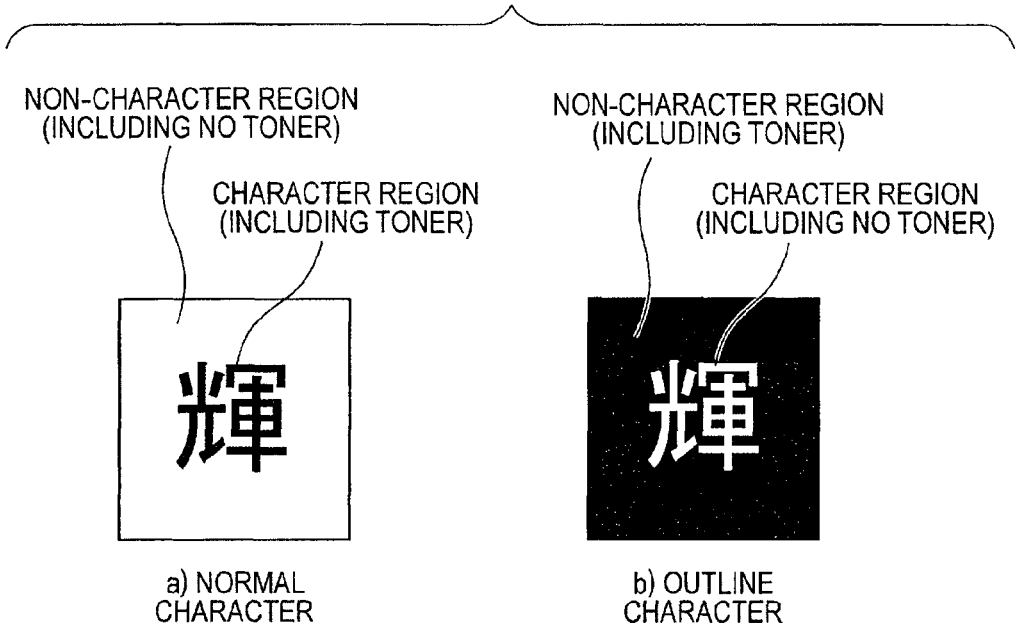
FIG. 3 is a drawing illustrating an example of a character composed of 15 parts concerning sharpness.

A, B, and C levels were determined as a preferred level because a character region was partially embedded with the toner even in the case where visibility was most inferior, wherein a portion of a line that formed the character (hereinafter, abbreviated to a character region) was a non-image region, and a portion excluding the character region was a toner image region, as shown in a 3 pt outline character of a character composed of 15 parts (FIG. 3).

A: not less than 0.25

B: not less than 0.20 and less than 0.25

C: not less than 0.15 and less than 0.20

D: not less than 0.10 and less than 0.15

E: less than 0.10

TABLE 3

| | | Evaluation of image | | | | | | |
|---|---|---|---|---|---|---|---|---|
| | | Evaluation of image | | | | | | |
| | | Image fogging | | | Developing stripes | | | Sharpness |
| | Toner No. | N/N environment | L/L environment | H/H environment | N/N environment | L/L environment | H/H environment | N/N environment |
| Example 1 | (1) | B | A | B | B | B | A | A |
| Example 2 | (2) | B | A | B | B | B | A | A |
| Example 3 | (3) | A | A | B | B | A | A | A |
| Example 4 | (4) | B | A | B | B | B | A | C |
| Example 5 | (5) | B | A | B | B | B | A | A |
| Example 6 | (6) | B | A | B | B | B | A | C |
| Example 7 | (7) | B | A | B | A | A | A | A |
| Example 8 | (8) | A | A | B | B | A | A | B |
| Example 9 | (9) | A | A | B | A | A | A | B |
| Example 10 | (10) | A | A | B | A | A | A | A |
| Example 11 | (17) | A | A | B | A | A | B | B |
| Example 12 | (18) | A | A | B | B | A | B | A |
| Example 13 | (19) | A | A | A | A | A | B | A |
| Comparative Example 1 | (11) | C | B | D | D | E | C | D |
| Comparative Example 2 | (12) | C | B | D | D | E | C | E |
| Comparative Example 3 | (13) | C | B | D | C | E | C | E |
| Comparative Example 4 | (14) | C | B | D | C | E | C | D |
| Comparative Example 5 | (15) | C | B | D | C | D | C | E |
| Comparative Example 6 | (16) | C | B | D | D | E | C | D |
| Comparative Example 7 | (20) | C | C | E | C | D | D | C |

Apparently from Tables 2-1 and 2-2, the colorant dispersion produced in the present invention has higher dispersibility of a colorant than that in the colorant dispersion in Comparative Example. Moreover, the colorant dispersion produced in the present invention demonstrates an effect of reducing the viscosity, enabling easy feed of the solution during the production process. During production of the toner, the colorant dispersion produced in the present invention has an effect of reducing fine particles and coarse particles. As a result, the toner to be obtained has high granulating properties. Consequently, apparently from Table 3, image fogging, developing stripes, and sharpness are preferable in an image in which the produced magenta toner is fixed.

Industrial Applicability

The present invention can provide a magenta toner having high dispersibility of a colorant and good spectral characteristics. The magenta toner can be used in an image forming apparatus using electrophotography.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-163863 filed Jul. 27, 2011, which is hereby incorporated by reference herein in its entirety.

The invention claimed is:

1. A magenta toner comprising magenta toner particles, each of which comprises a binder resin, a compound represented by a formula (1), and a colorant, wherein the colorant comprises a pigment having a quinacridone skeleton:

Formula (1)

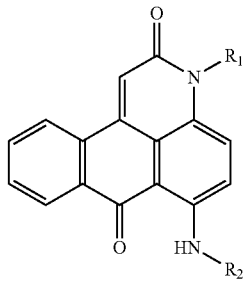

wherein $R_1$ and $R_2$ each independently represents a hydrogen atom, an alkyl group, an aryl group, or an aralkyl group, and the amount of the compound represented by the formula (1) is 0.01 to 10 parts by mass based on 100 parts by mass of the pigment having a quinacridone skeleton.

2. The magenta toner according to claim 1, wherein in the formula (1), $R_1$ is an alkyl group or an aryl group.

3. The magenta toner according to claim 1, wherein in the formula (1), $R_1$ is a methyl group, a n-butyl group, a cyclohexyl group, or a 4-methylphenyl group.

4. The magenta toner according to claim 1, wherein the pigment having a quinacridone skeleton is represented by a formula (2):

Formula (2)

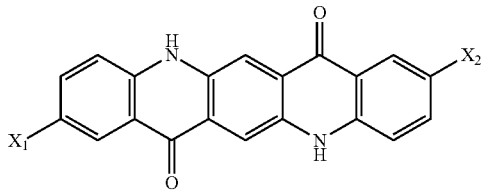

(wherein $X_1$ and $X_2$ each independently represent a hydrogen atom, an alkyl group, or a halogen atom.)

5. The magenta toner according to claim 1, wherein each of the magenta toner particles contains wax.

6. The magenta toner according to claim 1, wherein the magenta toner particles are obtained by a suspension polymerization method.)

7. The magenta toner according to claim 1, wherein the magenta toner particles are obtained by an emulsion agglomeration method.

8. A method for producing a magenta toner comprising the steps of:

mixing a compound represented by a formula (1) and a pigment having a quinacridone skeleton with an organic solvent to prepare a colorant dispersion;

mixing the colorant dispersion with a polymerizable monomer to prepare a polymerizable monomer composition;

dispersing the polymerizable monomer composition in a water-based medium and granulating the polymerizable monomer composition to produce droplets of the polymerizable monomer composition; and polymerizing the polymerizable monomer in the droplets to produce a magenta toner particle, wherein a toner to be obtained is a magenta toner comprising magenta toner particles, each of which comprises a binder resin, the compound represented by the formula (1), and a colorant, and the colorant comprises a pigment having a quinacridone skeleton:

Formula (1)

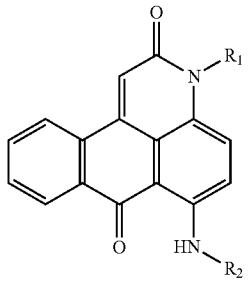

wherein $R_1$ and $R_2$ each independently represent a hydrogen atom, an alkyl group, an aryl group, or an aralkyl group, and the amount of the compound represented by the formula (1) is 0.01 to 10 part by mass based on 100 parts by mass of the pigment having a quinacridone skeleton.

9. A method for producing a magenta toner comprising the steps of:

mixing a compound represented by a formula (1) and a pigment having a quinacridone skeleton with an organic solvent to prepare a colorant dispersion;

mixing the colorant dispersion and the binder resin with an organic solvent to prepare a solvent composition;

dispersing the solvent composition in a water-based medium and granulating a particle of the solvent composition; and removing the organic solvent from the particle to produce a magenta toner particle, wherein a toner to be obtained is a magenta toner comprising magenta toner particles, each of which comprises a binder resin, a compound represented by a formula (1), and a colorant, and the colorant comprises a pigment having a quinacridone skeleton:

Formula (1)

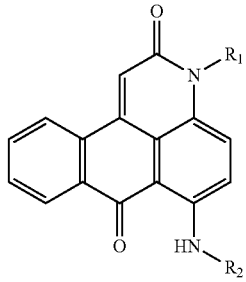

wherein $R_1$ and $R_2$ each independently represent a hydrogen atom, an alkyl group, an aryl group, or an aralkyl group, and the amount of the compound represented by the formula (1) is 0.01 to 10 100 parts by mass of the pigment having a quinacridone skeleton.

10. The magenta toner according to claim 1, wherein the amount of the compound represented by the formula (1) is 0.1 to 5 parts by mass based on 100 parts by mass of the pigment having a quinacridone skeleton.

11. The magenta toner according to claim 1, wherein the compound represented by the formula (1) is selected from the group consisting of the following compounds (2), (3), (5), (9), (15), (17), and (21):

Compound (2)

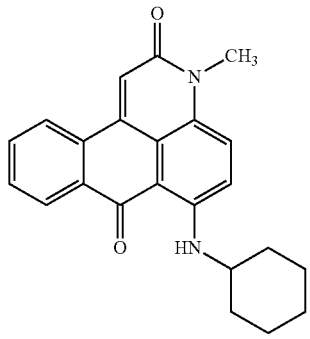

-continued
Compound (3)
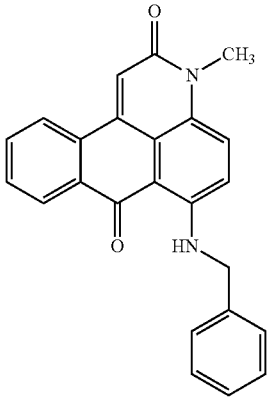
Compound (5)
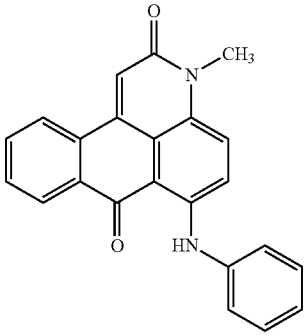
Compound (9)
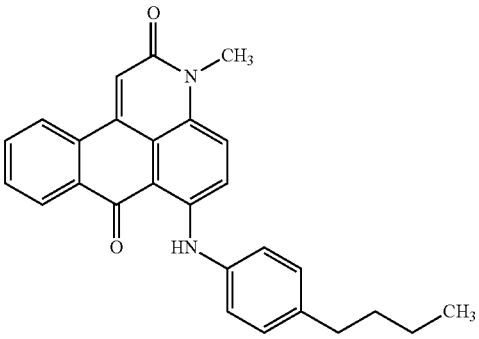
-continued
Compound (15)
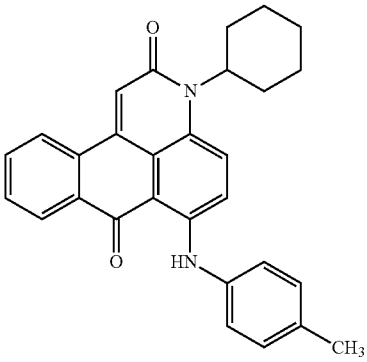
Compound (17)
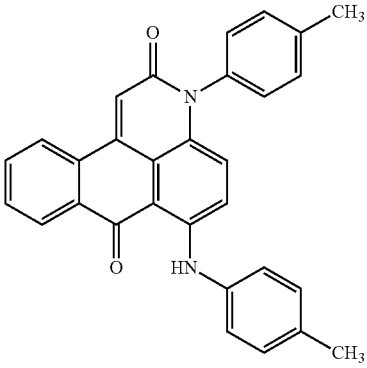
Compound (21)
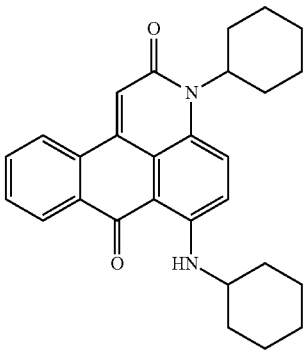
* * * * *